United States Patent [19]

Kamata

[11] Patent Number: 5,073,990

[45] Date of Patent: Dec. 24, 1991

[54] SHIELD PLATE MOUNTING STRUCTURE FOR HELMET

[75] Inventor: Eitaro Kamata, Tokyo, Japan

[73] Assignee: Shoei Kako Kabushiki Kaisha, Tokyo, Japan

[21] Appl. No.: 619,586

[22] Filed: Nov. 29, 1990

[30] Foreign Application Priority Data

Aug. 15, 1990 [JP] Japan ..... 2-215202

[51] Int. Cl.[5] ..... A42B 1/08

[52] U.S. Cl. ..... 2/424

[58] Field of Search ..... 2/9, 410, 422, 424, 2/425

[56] References Cited

U.S. PATENT DOCUMENTS

| | | | |
|---|---|---|---|
| 4,507,809 | 4/1985 | Stepan | 2/424 |
| 4,615,052 | 10/1986 | Nava | 2/424 |
| 4,748,696 | 6/1988 | Fohl | 2/424 |
| 4,907,299 | 3/1990 | Arai | 2/424 |
| 4,920,585 | 5/1990 | Arai | 2/424 |

FOREIGN PATENT DOCUMENTS

| | | | |
|---|---|---|---|
| 2913057 | 10/1980 | Fed. Rep. of Germany | 2/424 |
| 2352507 | 12/1977 | France | 2/424 |
| 63-15314 | 4/1988 | Japan . | |
| 64-10035 | 1/1989 | Japan . | |

*Primary Examiner*—Werner H. Schroeder
*Assistant Examiner*—Michael A. Neas
*Attorney, Agent, or Firm*—Armstrong, Nikaido, Marmelstein, Kubovcik & Murray

[57] ABSTRACT

The present invention is directed to a shield plate mounting structure for a helmet in which a cover mounted on a mounting base plate is fixed to an outer surface of a cap body to support the end portion of a shield plate. The mounting structure includes a main body for convering the end portion of the shield plate, and an extension plate integrally formed with the main body. The main body is engaged with the mounting base plate through an engaging device for allowing engaging and disengaging operation. The extension plate is provided with a locking hole. An engaging member is inserted into the locking hole when the main body is engaged with the mounting base plate. The main body on the mounting base plate operates between a position for engaging the engaging member with the peripheral edge of the locking hole and a position for disengaging the engagement of the engaging member from the locking hole. Mounting and dismounting of the shield plate on or from the cap body can be easily down without tools.

8 Claims, 6 Drawing Sheets

SHIELD PLATE MOUNTING STRUCTURE FOR HELMET

BACKGROUND OF THE INVENTION

1. Field of the Invention

The present invention relates to a structure for mounting a shield plate or a cap body of a helmet in which a mounting base plate having a pivot section for turnably supporting an end portion of the shield plate is fixedly secured to an outer surface of the cap body and a cover for covering the end portion of the shield plate is detachably mounted on said mounting base plate.

2. Description of the Prior Art

Heretofore, in such a mounting structure, screws have been employed for preventing the shield plate from falling off the pivot section or for attaching the cover to the cap body, for example, as disclosed in Japanese Utility Model Laid-Open No. 64-10035 and Japanese Utility Model Publication No. 63-15314.

In general, in a helmet, the shield plate may be exchanged for a so-called clear type or a sunshade type shield plate in response to a user's liking or usage. According to the conventional structure as described above, screws must be detached and attached at the time of exchanging the shield plate, and such an operation is troublesome.

SUMMARY OF THE INVENTION

The present invention has been accomplished with such circumstances in view. It is an object of the present invention to provide a shield plate mounting structure for a helmet wherein a shield plate can easily be exchanged without the necessity of detaching and attaching the screws.

To accomplish the above object, according to the present invention, there is provided a shield plate mounting structure in which a mounting base plate having a pivot section for turnably supporting and end portion of a shield plate is fixedly secured to an outer surface of a cap body. A cover for covering the end portion of the shield plate is detachably mounted on the mounting base plate wherein the cover comprises a cover main body portion for covering the end portion of the shield plate, and an extension plate portion is integrally formed with the cover main body portion. The cover main body portion is engaged with the mounting base plate through an engaging device which permits an engaging and disengaging operation in a linear engaging and disengaging direction that is set substantially perpendicular to an axis of the pivot section. The extension plate portion is provided with a locking hole; the mounting base plate further comprises an engaging member to be passed through the locking hole only when the cover main body portion is engaged with the mounting base plate; and the engaging member is operable between a position of engaging with the peripheral edge of the locking hole and a position of being released.

With such a construction, when mounting the shield plate on the cap body, the end portion of the shield plate is superposed on the mounting base plate fixed to the cap body. The cover is further superposed on the shield plate. The cover main body portion is operated in its engaging and disengaging direction to be engaged with the mounting base plate. Then, since the engaging member can be inserted into the locking hole, the engaging member is operated in the direction to be engaged with the edge of the locking hole to secure the cover to the mounting base plate. For detaching the shield plate from the cap body, the reverse operation to that described above may be conducted. In both the operations, a tool is not required.

These and other objects and features of the present invention will become apparent from the following detailed description in conjunction with the attached drawings.

BRIEF DESCRIPTION OF THE DRAWINGS

The drawings illustrate one embodiment of the present invention, wherein.

DESCRIPTION OF THE PREFERRED EMBODIMENT

The present invention will now be described by way of one embodiment with reference to the accompanying drawings.

Figure 1:
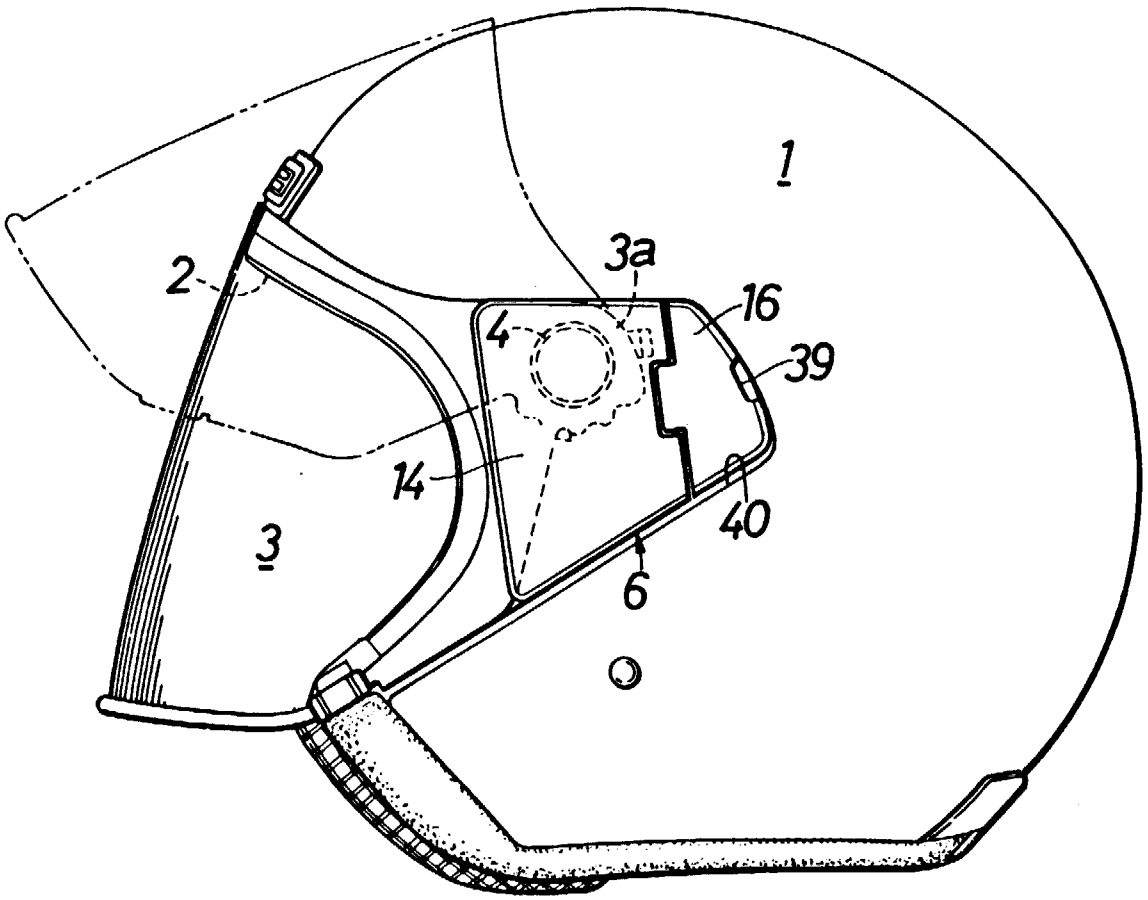
FIG. 1 is a side view of a helmet according to the present invention.
Figure 2:
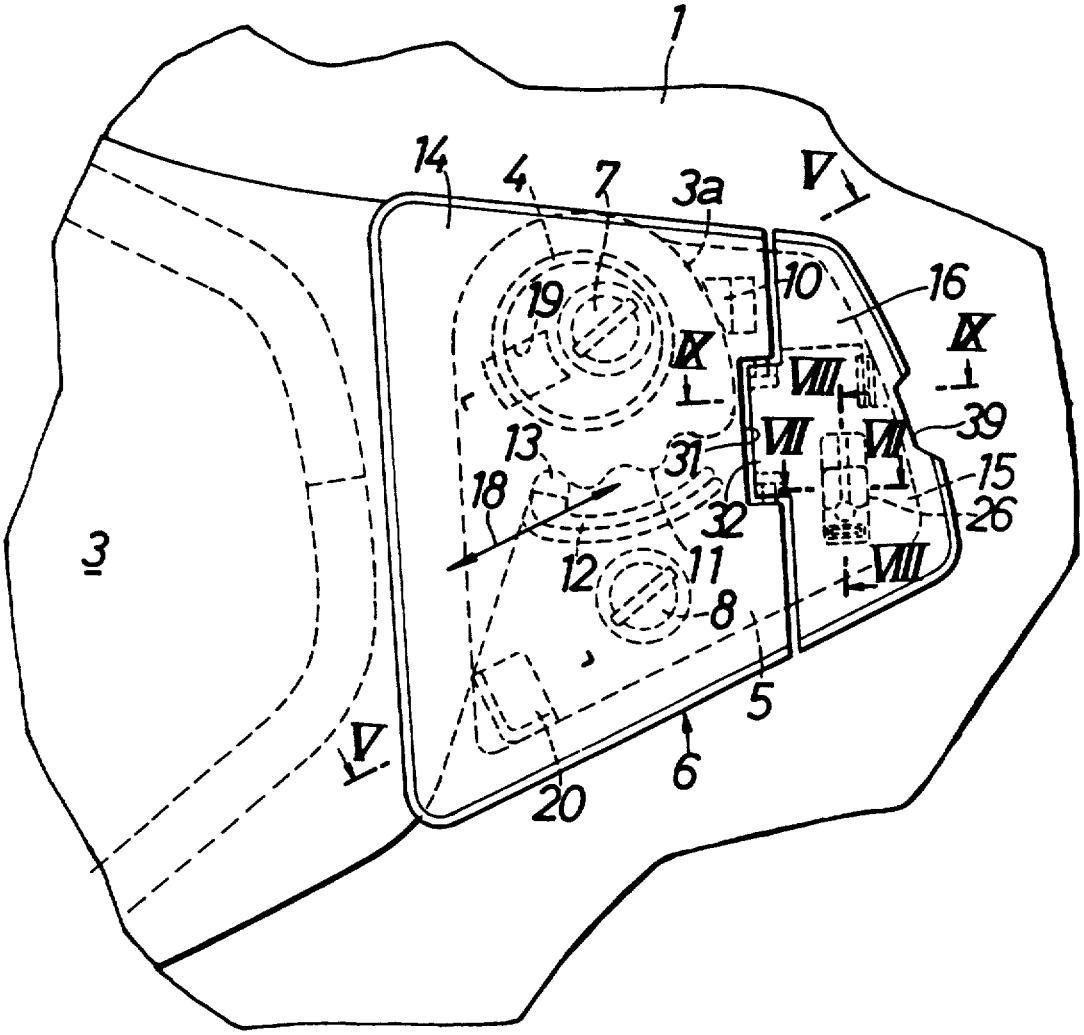
FIG. 2 is an enlarged view of an essential portion of FIG. 1.
Figure 3:
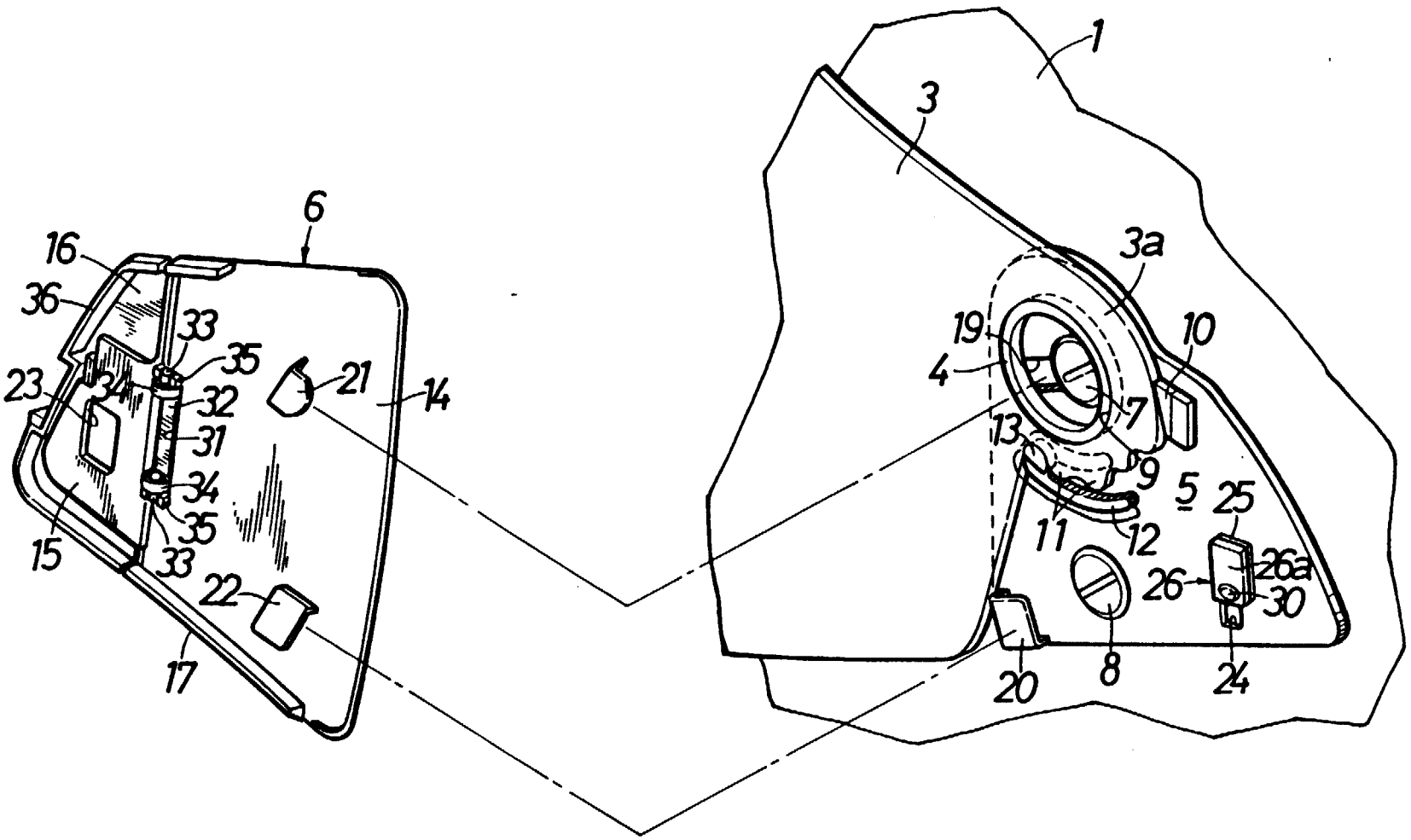
FIG. 3 is an exploded perspective view of a mounting structure.
Figure 4:
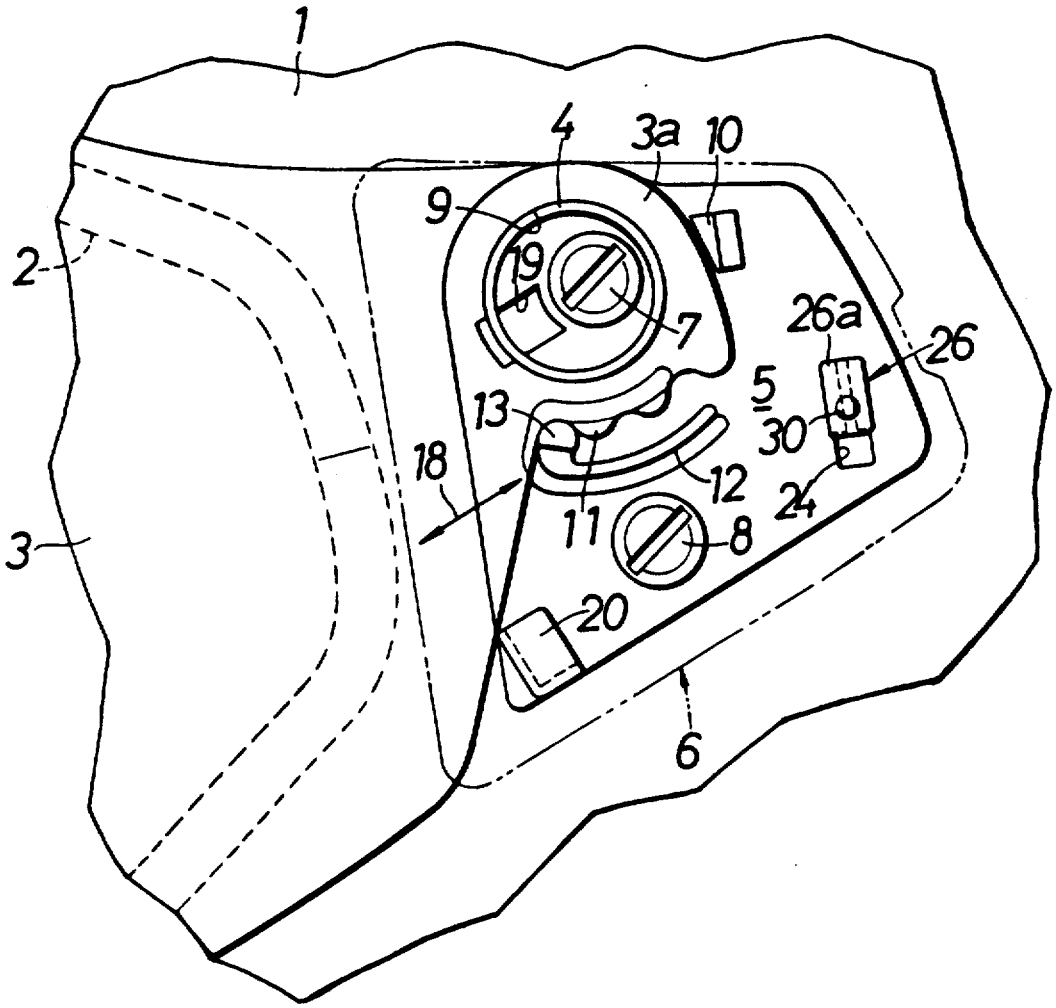
FIG. 4 is a side view corresponding to FIG. 2 in a state where a cover is removed.
Figure 5:
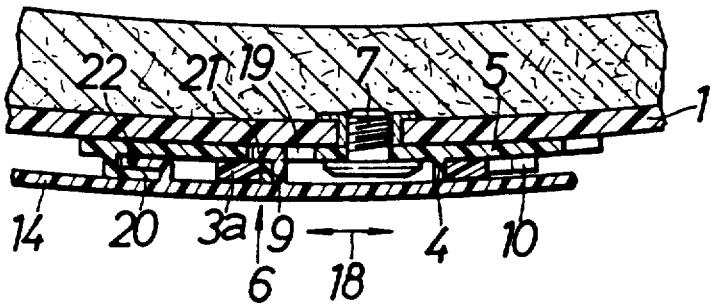
FIG. 5 is a sectional view taken along the line V—V of FIG. 2.

Referring first to FIG. 1, this helmet is a so-called jet type helmet, both left and right end portions 3*a* of a shield plate 3 made of a synthetic resin for opening and closing a window 2 provided in a front face of a cap body 1 are attached to both left and right side walls of the cap body 1 by means of a mounting structure according to the present invention. The shield plate 3 can be turnably operated in a click stop manner between a closing position indicated by a solid line and an opening position indicated by a dotted broken line in FIG. 1.

Referring also to FIGS. 2 to 5, a mounting base plate 5 made of synthetic resin having a pivot section 4 for turnably supporting the end portion 3*a* of the shield plate 3 is fixedly secured to an outer surface of each of the left and right side walls of the cap body 1, and a cover 6 made of synthetic resin for covering the end portion 3*a* of the shield plate 3 is detachably mounted to the mounting base plate 5.

The mounting base plate 5 is secured at upper and lower positions thereof to left and right outer surfaces of the cap body 1 with screws 7 and 8. The cylindrical pivot section 4 surrounding the head of the upper screw 7 is integrally projected on the surface of the mounting base plate 5 by an axial length corresponding to the thickness of the end portion 3*a* of the shield plate 3. An axial hole 9 is formed in the end portion 3*a* of the shield plate 3. The pivot section 4 is turnably fitted in the axial hole 9 of the shield plate 3 to turnably support the shield plate 3 about the pivotal section 4. A restricting projection 10 in contact with the outer peripheral edge of the end portion 3a of the shield plate 3 is projected on the mounting base plate 5 so as to restrict the upper limit position of the turning movement of the shield plate 3.

Provided on the lower outer peripheral of the end portion 3a of the shield plate 3 are a plurality of click teeth 11 which are arranged on a concentric circle with respect to the axial hole 9 of the shield plate 3. On the other hand, a resilient arm 12 is formed by cutting out a part of the mounting base plate 5, and a click tooth 13 provided at a distal end of the resilient arm 12 is resiliently engaged with a part of the click teeth 11 of the shield plate 3. Thus, the shield plate 3 is held at its turned position by the resilient engagement of the click tooth 13 with the click teeth 11.

The cover 6 comprises a cover main body 14 detachably engaged with the mounting base plate 5 to cover the end portion 3a of the shield plate 3, an extension plate 15 continuously formed with the main body 14 for closely contacting with the surface of the mounting base plate 5, and a lid 16 turnably supported by the main body 14 for covering the extension plate 15.

A leg 17 is projected on the inner surface of the peripheral edge of the main body 14. The inner surface of the main body 14 is brought into abutment against the end face of the pivot section 4 in a state where the leg 17 is abutted against the outer surface of the cap body 1 and the main body 14 is engaged with the mounting base plate 5. A part of the leg 17 corresponding to the turning range of the shield plate 3 is eliminated so that the shield plate 3 which is sandwiched between the main body 14 and the mounting base plate 5 can be turned.

The main body 14 in engageable with the mounting base plate 5 by the operation along a linear engaging or disengaging direction 18 which is substantially perpendicular to an axis of the pivot section 4. More particularly, a rectangular slot 19 is perforated in the mounting base plate 5 extending along the engaging and disengaging direction 18 and reaching under a base end of the pivot section 4, and a locking portion 20 is integrally formed on the mounting base plate 5 at a position lower than the end portion 3a of the shield plate 3 which is in the closing position. The locking portion 20 is formed to be opposed to the surface of the mounting base plate 5 with a rear side of the locking portion 20 (at the right side in FIGS. 3 and 4) along the engaging and disengaging direction 18 and an upper portion of the locking portion 20 opened. On the other hand, the inner surface of the main body 14 is integrally provided with an L-shaped engaging pawl 21 to be in the slot 19 within the pivot section 4. The engaging pawl 21 can be engaged with and held under the base end of the pivot section 4 by the forward (leftward in FIGS. 3 and 4) movement along the engaging and disengaging direction 18 from the state where the engaging pawl 21 is received in the slot 19 within the pivot section 4. Further, the inner surface of the main body 14 is also integrally provided with an L-shaped engaging pawl 22 to be engaged with the locking portion 20 by the forward movement from the rear side of the locking portion 20 along the engaging and disengaging direction 18. The slot 19 and the engaging pawl 21 as well as the locking portion 20 and the engaging pawl 22 constitute engaging means, respectively. Since one of the engaging means is arranged in the pivot section 4 while the other is arranged lower than the end portion 3a of the shield plate 3 when the shield plate 3 is closed. The opening and closing operations of the shield plate 3 are not disturbed at all by the engaging means.

Figure 6:
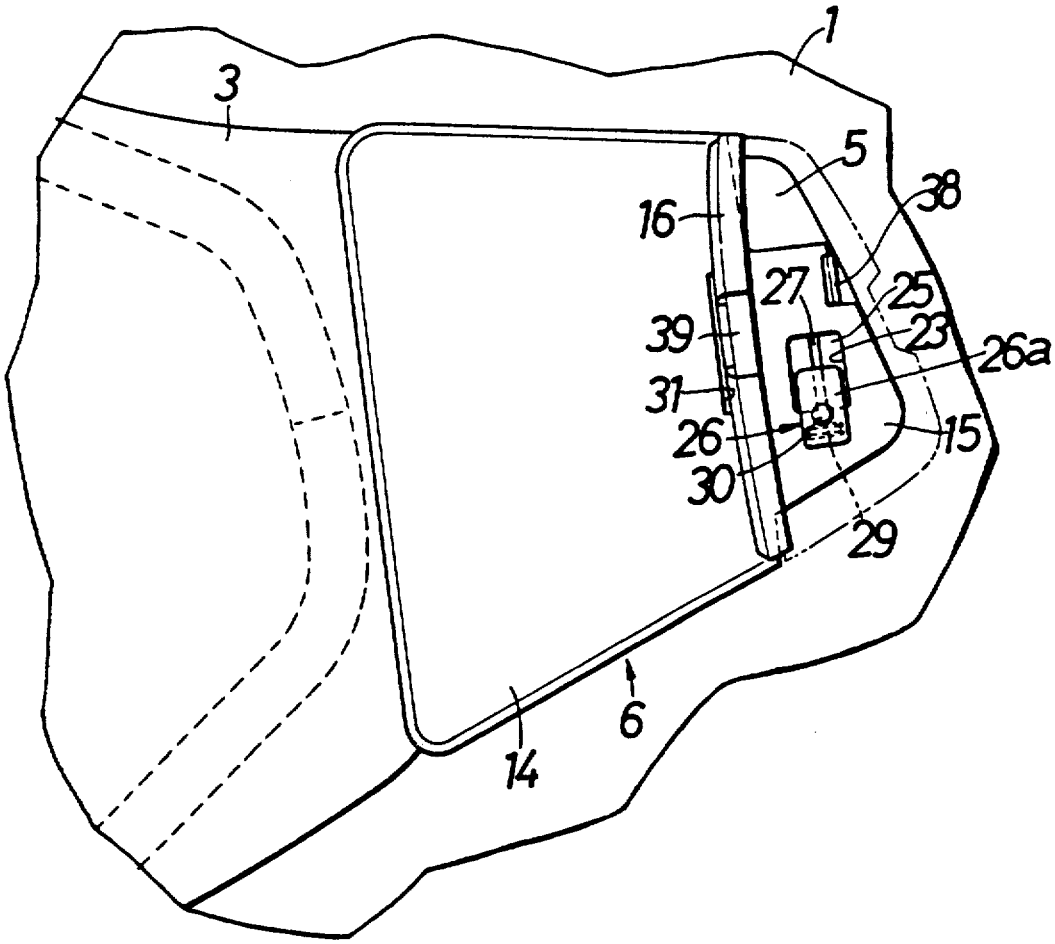
FIG. 6 is a side view corresponding to FIG. 2 in a state where a part of the cover is opened.
Figure 7:
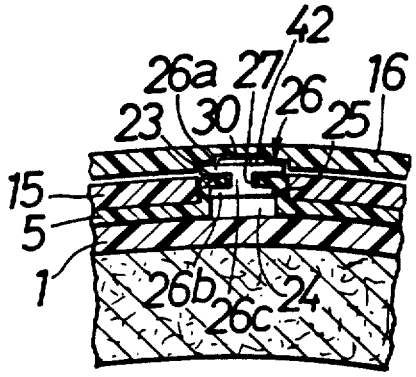
FIG. 7 is an enlarged sectional view taken along the line VII—VII of FIG. 2.
Figure 8:
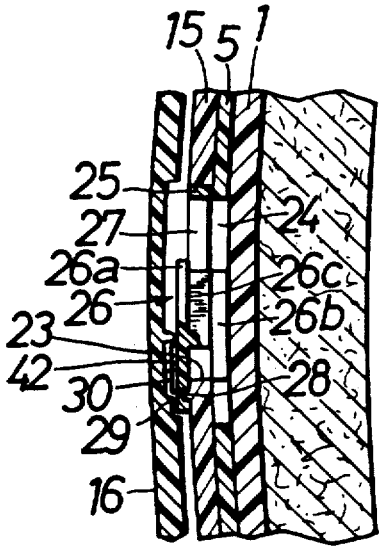
FIG. 8 is an enlarged sectional view taken along the line VIII—VIII of FIG. 2.

Referring also to FIGS. 6, 7 and 8, the extension plate 15 of the cover 6 is integrally formed with the main body 14 with a thinner thickness than that of the main body 14 for closely contacting with the surface of the mounting base plate 5 in a state where the main body 14 is engaged with the mounting base plate 5. A rectangular locking hole 23 extending vertically to cross the engaging and disengaging direction 18 is formed in the extension plate 15 of the cover 6.

On the other hand, a guide hole 24 is formed in the mounting base plate 5 to extend vertically, and a rectangular supporting frame 25 is integrally formed with the mounting base plate 5 over an upper portion of the guide hole 24. The supporting frame 25 is inserted in the locking hole 23 in a state where the main body 14 is engaged with the mounting base plate 5. When the supporting frame 25 is inserted in the locking hole 23, the outer surface of the supporting frame 25 is flush with the surface of the extension plate 15. A slit 27 extending longitudinally of the guide hole 24 is formed in the supporting frame 25. An engaging member 26 to be engaged with the peripheral edge of the locking hole 23 is supported on the supporting frame 25.

The engaging member 26 is comprised of an engaging plate 26a slidable along the surface of the supporting frame 25, a moving plate 26b movable along the guide hole 24, and a coupling portion 26c movably fitted in the slit 27 for coupling the engaging plate 26a and the moving plate 26b. The moving plate 26b is formed substantially in the same rectangular shape as the supporting frame 25. The lower end of the engaging plate 26a is projected downward lower than the lower end of the coupling portion 26c, and an engaging recess 28 is formed on an inner surface of the lower end of the engaging plate 26a. On the other hand, a locking projection 29 to be engaged with the engaging recess 28 is projected on the surface of the extension plate 15 at the lower edge around the locking hole 23. An operating knob 30 is projected on the engaging plate 26a.

With such a construction, when the main body 14 of the cover 6 is engaged with the mounting base plate 5 in a state where the engaging member 26 is located at its upper position where the engaging plate portion 26a is not protruded from the supporting frame 25, the supporting frame 25 can be inserted in the locking hole 23 of the extension plate 15. When the engaging member 26 is moved downward by handling the operating knob 30 in this state, the engaging plate 26a rides on the locking projection 29 to resiliently engage the locking projection 29 with the engaging recess 28.

Figure 9:
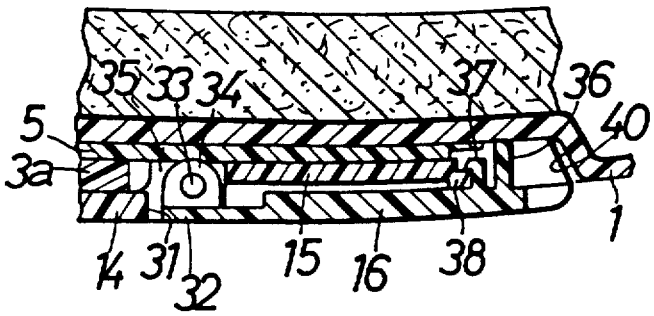
FIG. 9 is an enlarged sectional view taken along the line IX—IX of FIG. 2.

Referring also to FIG. 9, the lid 16 of the 6 is supported on the main cover body 14 for turning between its closing position (the position shown in FIG. 2) for covering the extension plate 15 where the lid 16 is flush with the main body 14 and its opening position (the position shown in FIG. 6) for externally exposing the extension plate 15. In other words, a rectangular notch 31 is provided at the rear of the main body 14, and an arm 32 disposed in the notch 31 is provided at the lid 16 of the cover 6. A pair of bearings 34 are integrally formed with inner surfaces of both upper and lower ends of the arm 32, and a pair of shafts 33 are fitted at one ends thereof into the bearings 34, respectively. And U-shaped brackets 35 are integrally formed on the inner surface of the main body portion 14 at the upper and lower edges of the notch 31, and the other ends of the shafts 33 are resiliently and turnably held by the brackets 35, respectively. Accordingly, the lid 16 is turnably supported on the main body 14 through the shafts 33.

A leg 36 is projected on the inner surface of the peripheral edge of the lid 16 excluding the cover main body portion 14 side, and the outer surface of the plate 16 becomes substantially flush with the outer surface of the main body 14 in a state where the leg 36 is brought into contact with the outer surface of the cap body 1.

An engaging pawl 37 is projected on the inner surface of the lid 16 of the cover 6, and a locking portion 38 to be resiliently engaged with the engaging pawl 37 is provided at the extension plate 15 of the cover 6. Accordingly, the engaging pawl 37 is resiliently engaged with the locking 38 to maintain the lid 16 covering the extension plate portion 15. An operating recess 39 is provided at the side opposite to the arm portion 31 of the lid 16, and, when the lid 16 covering the extension plate portion 15 is to be opened, a finger can be inserted in the operating recess 39. A restricting recess 42 to be engaged with the operating knob 30 is provided in the inner surface of the lid 16 in a state that the engaging plate 26a of the engaging member 26 is engaged with the lower edge of the locking hole 23.

Recesses 40 are provided at both sides of the window 2 of the cap body 1. The mounting base plate 5 is disposed in each recess 40, and the outer surface of the cover 6 which is mounted on the cap body 1 becomes substantially flush with the outer surface of the cap body 1.

A description will now be made of the operation of this embodiment.

When mounting the shield plate 3 on the cap body 1, the end portion 3a of the shield plate 3 is superposed on the mounting base plate which is fixedly secured to the cap body 1, so as to insert the pivot section 4 in the axial hole 9 of the end portion 3a of the shield plate 3. Then, the lid 16 of the cover 6 is opened to externally expose the extension plate 15. When the engaging member 26 is located at a position corresponding to the supporting frame 25, the cover 6 is intended to be superposed on the end portion 3a of the shield plate 3 while advancing the main body 14 forwardly along the engaging and disengaging direction 18. Thus, the engaging pawl 21 is engaged with the base end of the pivot section 4 through the slot 19, and the engaging pawl 22 is engaged with the locking portion 20. Accordingly, the main body 14 is engaged with the mounting base plate 5. The engaging member 26 is inserted into the locking hole 23 in this state, the engaging member 26 is operated downwardly to resiliently be engaged with the lower end peripheral of the locking hole 23, thereby fixing the cover 6 to the mounting base plate 5. Then, the lid 16 is turned to its closing position until the engaging pawl 37 is resiliently engaged with the locking portion 38, thereby completing the mounting of the shield plate 3 on the cap body 1. In this mounting operation, a detaching and attaching operation of screws is eliminated, and the shield plate 3 can be mounted very easily. In addition, when the lid 16 is closed, the lid 16 covering the engaging member 26 prevents the latter from contacting objects outside. Further, the operating projection 30 is fitted in the restricting recess 42 to restrict the movement of the engaging member 26. Accordingly, unless the lid 16 is operated to its opening position, there is no fear of erroneously releasing the engagement of the engaging member 26 with the extension plate 15 of the cover 6.

In the case of removing the shield plate 3 from the cap body 1, the reverse operation to that described above may be performed. In both the operations, the detaching and attaching operation of screws are eliminated, resulting in a simplifying of the detaching and attaching of the shield plate 3, and hence, the latter can be exchanged easily.

In the embodiment described above, the structure of the present invention is applied to the jet type helmet. However, the present invention may also be applied to a full-face type helmet.

What is claimed is:

1. A shield plate mounting structure for a helmet which has a cap body, a shield plate detachably mounted on the cap body and a cover for covering an end portion of the shield plate, said mounting structure comprising:

a mounting base plate fixed to an outer surface of the cap body and having a pivot section turnably supporting the end portion of the shield plate, the cover being detachably mounted on said mounting base plate;

a cover main body portion covering the end portion of the shield plate, said cover main body portion having an engaging device for engaging said mounting base plate so as to permit an engaging and disengaging operation in a linear engaging and disengaging direction set substantially perpendicular to an axis of the pivot section;

an extension plate portion integrally formed with the cover main body portion and including a locking hole; and a lid portion supported on the cover main body portion, said lid portion being turnable between a closing position covering said extension plate portion and an opening position for externally exposing said extension plate portion, and further said lid portion being capable of resiliently engaging said extension plate portion, said mounting base plate further including an engaging member passing through the locking hole when said cover main body portion is engaged with said mounting base plate, and the engaging member being operable between a position of engaging with a peripheral edge of the locking hole and a position of being released from engagement.

2. A shield plate mounting structure of a helmet according to claim 1, wherein the pivot section is formed in a cylindrical shape, and the engaging device includes first engaging means disposed in the cylindrical pivot section.

3. A shield plate mounting structure of a helmet according to claim 2, wherein the first engaging means includes a rectangular slot extending along the engaging and disengaging direction provided on the mounting base plate to pass through the base portion of the pivot section, and a substantially L-shaped first engaging pawl that is provided on an inner surface of said cover main body portion for engaging with the slot so as to be engaged with the base portion of the pivot section by the movement of the first engaging pawl in the slot along the engaging and disengaging direction.

4. A shield plate mounting structure of a helmet according to claim 2 or 3, wherein the engaging device further includes second engaging means, disposed below the end portion of said shield plate at the closing position thereof.

5. A shield plate mounting structure of a helmet according to claim 4, wherein the second engaging means includes a locking portion integrally provided on the mounting base plate and opened at one side along the engaging and disengaging direction so as to be opposed to the surface of the mounting base plate, and a substantially L-shaped second engaging pawl provided on the inner surface of said cover main body portion so as to be engaged with the locking portion by the movement of the second engaging pawl along the engaging and disengaging direction.

6. A shield plate mounting structure of a helmet according to claim 1, wherein said engaging member is provided with an engaging recess, and a locking projection to be resiliently engaged with said engaging recess is projected on the edge of said locking hole so as to maintain the engagement of said engaging member with the edge of said locking hole.

7. A shield plate mounting structure of a helmet according to claim 1, wherein means for resiliently engaging said lid portion with said extension plate portion is comprised of a locking portion projected on an inner surface of said lid portion, and a locking pawl provided on said extension plate portion to be resiliently engaged with said locking portion.

8. A shield plate mounting structure of a helmet according to claim 1, wherein said lid portion is provided at an inner surface thereof with a restricting recess for receiving an operating projection projected on an outer surface of said engaging member when said lid portion is located at its closing position in a state where said engaging member is engaged with the peripheral edge of said locking hole.

* * * * *